US006148145A

United States Patent [19]

Kadotani

[11] Patent Number: 6,148,145

[45] Date of Patent: Nov. 14, 2000

[54] MULTI-TEMPERATURE CONTROL SYSTEM AND FLUID TEMPERATURE CONTROL DEVICE APPLICABLE TO THE SAME SYSTEM

[75] Inventor: Kanichi Kadotani, Hiratsuka, Japan

[73] Assignee: Komatsu Ltd., Tokyo, Japan

[21] Appl. No.: 09/388,896

[22] Filed: Sep. 2, 1999

Related U.S. Application Data

[62] Division of application No. 08/765,918, Jan. 3, 1997.

[30] Foreign Application Priority Data

| | | | |
|---|---|---|---|
| Nov. 30, 1995 | [JP] | Japan | 7-312048 |
| Feb. 15, 1996 | [JP] | Japan | 8-028021 |
| Jun. 20, 1996 | [JP] | Japan | 8-180102 |
| Jun. 20, 1996 | [JP] | Japan | 8-180103 |

[51] Int. Cl.[7] ..... A21B 2/00

[52] U.S. Cl. ..... 392/416; 219/476; 165/104.19; 392/485

[58] Field of Search ..... 392/416, 418, 392/483, 485, 488, 489, 496; 219/476, 478, 480; 165/104.19, 104.33

[56] References Cited

U.S. PATENT DOCUMENTS 3,519,255 7/1970 Cooper ..... 432/30

5,559,924 9/1996 Kadotani et al. ..... 392/483

*Primary Examiner*—Mark Paschall
*Assistant Examiner*—Shawntina Fuqua
*Attorney, Agent, or Firm*—Koda & Androlia

[57] ABSTRACT

A fluid temperature control device is improved to be simpler in structure, less in fluid temperature non-uniformity, and able to heat a fluid having a small light absorbability. The fluid temperature control device has a cylindrical inner vessel (20), a cylindrical outer vessel (22) surrounding the inner vessel (20), and a heating lamp (25) inserted into the inner vessel (20). Metal fins (28*a*) and (28*b*) are provided on the inner and outer circumferential surfaces of the inner vessel (20). A working fluid is passed through the inner space (21) between the inner vessel (20) and the heating lamp (25) and a cooling liquid is passed through the outer space (23) between the inner vessel (20) and the outer vessel (22). Infrared rays from the heating lamp (25) heat the working fluid, and the cooling liquid cools the working fluid. This device is applicable to, for instance, temperature control of plural process chambers of semiconductor processing apparatus. A plurality of the temperature control devices are arranged in the vicinity of the semiconductor processing apparatus. Each of the devices is assigned to each of plural portions of the process chambers and provides the temperature-controlled fluid exclusively to each portion.

15 Claims, 13 Drawing Sheets

MULTI-TEMPERATURE CONTROL SYSTEM AND FLUID TEMPERATURE CONTROL DEVICE APPLICABLE TO THE SAME SYSTEM

This application is a divisional of Ser. No. 08/765,918 filed Jan. 3, 1997.

TECHNICAL FIELD OF THE INVENTION

The present invention relates to a multi-temperature control system for controlling temperatures at a plurality of places using circulation of a working fluid, and also relates to a fluid temperature control device which is applicable to the same system.

The multi-temperature control system according to the present invention can be preferably used, for instance, to control temperatures of various portions in a plurality of process chambers (reaction processing chambers) of a semiconductor processing apparatus; without being limited only thereto, however, this system can be applied to the other various reaction processing apparatus.

The fluid temperature control device according to the present invention is applicable not only to the multi-temperature control system of this invention, but also to the other various type temperature control systems.

BACKGROUND OF THE INVENTION

The conventional semiconductor processing apparatus is constructed as shown in FIG. 1, for instance. In more detail, a plurality of process chambers 2*a*, 2*b* and 2*c* are arranged around a transfer chamber 1. A wafer (not shown) to be processed is carried from a process chamber to another process chamber via the transfer chamber 1 by use of a carrier robot (not shown) provided within the transfer chamber 1. A specific reaction is performed on the wafer in each of the process chambers 2*a*, 2*b* and 2*c*, respectively.

FIG. 2 shows a construction of each process chamber, which is composed of a chamber wall 3, a chamber cover which functions as an anode, and a wafer support base 6 which functions as a cathode. The chamber wall 3, the chamber cover 4 and the wafer support base 6 are provided with pipe lines 7*a*, 7*b* and 7*c* through which working fluids for controlling temperature flow, respectively. The working fluid flowing through each of these pipe lines 7*a*, 7*b* and 7*c* controls each temperature of the chamber wall 3, the chamber cover 4 and the wafer support base 6 to each of specific target temperatures T1, T2 and T3 separately.

The prior art temperature control system applied to the semiconductor processing apparatus, as shown in FIG. 1, comprises three temperature control machines 8*a*, 8*b* and 8*c* in each of which each of the target temperatures T1, T2 and T3 is set. Each of the temperature control machines 8*a*, 8*b* and 8*c* supplies each temperature-controlled working fluid to all of the process chambers 2*a*, 2*b* and 2*c* of the semiconductor processing apparatus. For instance, the first temperature control machine 8*a* supplies the working fluid to the chamber walls 3 of all the process chambers 2*a*, 2*b* and 2*c* through three pairs of fluid circulation pipes 9*a*, 9*b*; 9*a*, 9*b*; and 9*a*, 9*b*. In the same way, the second temperature control machine 8*b* supplies the working fluid to the chamber covers 4 of all the process chambers 2*a*, 2*b* and 2*c*; and the third temperature 8*c* supplies the working fluid to the wafer support bases 6 of all the process chambers 2*a*, 2*b* and 2*c*.

As shown in FIG. 3, each temperature control machine is provided with a heat exchanger 11 for cooling the working fluid, a heater 13 for heating the working fluid, and a pump 14 for circulating the temperature-controlled working fluid through the circulation pipes 9*a* and 9*b*. The heat exchanger 11 cools the working fluid by passing cooling water through a cooling water pipe 10. The heater 13 accumulates the working fluid in a tank 13*a* and then heats the working fluid in the tank 13*a* by an electric heater 12.

As described above, in the prior art temperature control system used for the semiconductor processing apparatus, one temperature control machine is used in common for a plurality of the process chambers; that is, one temperature control machine controls temperature at specific portions of a plurality of process chambers in centralization manner.

Accordingly, since the target temperature is controlled in common at the temperature-controlled portion of each of a plurality of the process chambers, it is impossible to change each target temperature at each temperature-controlled portion according to each process chamber in principle. In addition, it is also impossible to control all the temperatures of the portions of all the process chambers at the same level accurately. This is because the shape, operating condition, circulation pipe length, pressure loss, etc. differ according to each process chamber, so that the temperature of the working fluid differs slightly according to each process chamber.

Here, in order to control each target temperatures according to each process chamber, it may be possible to consider such a method of controlling the flow rate of the working fluid according to each chamber. In this method, however, since the control construction may be considerably complicated, and further since the fluid flow rate control may be interfered with each other between the process chambers, it is difficult to control the temperature accurately.

Further, in the prior temperature control system, since the centralized-control is executed, as shown in FIG. 1, the temperature control machines are inevitably located an appropriate distance apart from the semiconductor processing apparatus. As a result, the fluid circulation pipes are inevitably lengthened, and further the quantity of working fluid to be used increases. It is preferable to use as the working fluid a non-active fluid such as GALDEN (Trademark) or FLUORINERT (Trademark). However, since these non-active working fluids are considerably expensive, it is not preferable to use a large quantity of these fluid. Therefore, in the prior art temperature control system, a low-cost working fluid such as ethylene glycol or water is used, excepting special circumstances. However, since the low-cost working fluid produces ions by the influence of plasma generated within the process chamber and thereby the process chamber is easily corroded, a deionizing instrument of large size and of high cost is additionally required.

Further, in the prior art temperature control system, since the fluid circulation pipes are relatively long, the thermal loss is large in the circulation pipes. As a result, a relatively large heat capacity is necessary for each temperature control machine. In summary, the size of the prior art temperature control system is inevitably increased due to the large heat capacity and the installation place thereof.

As described above, working fluids are preferably used to control the temperatures of various objects such as a wall of a processing chamber of a semiconductor processing apparatus, air supplied to a constant temperature chamber and the like. The temperature of each working fluid must be controlled to a target temperature according to each object.

The prior art devices for controlling the temperature of the working fluid are disclosed in Japanese Published Unexamined (Kokai) Patent Application Nos. 58-219374, 7-280470, and 5-231712, for instance.

The fluid temperature control device disclosed by Japanese Published Unexamined (Kokai) Patent Application No. 58-219374 comprises a roughly cylindrical water flow passage which is partitioned finely so that water can flow in spiral state therethrough. A long and narrow electric heater is inserted into the central portion of the cylindrical water flow passage. Further, the outer circumferential surface of this cylindrical water flow passage is covered by another roughly cylindrical cooling medium flow passage which is also partitioned so that a condensed cooling medium can flow also in spiral state therethrough. Therefore, the water flowing through the water flow passage can be heated and cooled by the electric heater and the condensed cooling medium.

In the fluid temperature control device disclosed by Japanese Published Unexamined (Kokai) Patent Application No. 7-280470, an electric heater is inserted into a central portion of a pipe through which a working fluid flows, and the outer circumference of the pipe is covered by a large diameter pipe through which cooling water can flow. Therefore, the temperature of the working fluid flowing through the pipe can be controlled by the electric heater and the cooling water.

In the fluid temperature control device disclosed by Japanese Published Unexamined (Kokai) Patent Application No. 5-231712, a hollow pipe formed of quartz glass is arranged at the central portion of a cylindrical vessel through which a working fluid flows, and an infrared ray lamp is inserted into the hollow pipe. Therefore, the fluid in the vessel can be heated by the radiation heat emitted by the lamp.

In the device disclosed by Japanese Published Unexamined (Kokai) Patent Application No. 7-280470, since thermal conduction from the heater to the cooling water is utilized, there inevitably exists a non-uniforminity of the temperature of the working fluid according to the distance from the heat source. For instance, the fluid temperature is relatively high in the vicinity of the heater but low at a place remote from the heater.

In the device disclosed by Japanese Published Unexamined (Kokai) Patent Application No. 58-219374, since the fluid may be stirred when it flows helically, the non-uniformity of the fluid temperature may not occur substantially. However, since the structure of the helical flow passage is complicated, the manufacturing and maintenance process thereof is troublesome.

Further, with the devices utilizing thermal conduction, since temperature becomes locally very high in the vicinity of the heater, it is necessary to suppress the heater temperature so that the working fluid passing near the heater will not be boiled or that the heater temperature will not exceed the heat resistance limit of the materials of the heater and other vicinal elements. As a result, it is rather difficult to supply a large quantity of heat to the working fluid and further to set the target temperature of the working fluid at a high value.

The device disclosed by Japanese Published Unexamined (Kokai) Patent Application No. 5-231712 utilizes heat radiation (i.e., heat supply by electromagnetic waves, mainly by infrared rays) instead of thermal conduction. In this device, since the radiation heat of infrared rays can be emitted to all the places in the fluid uniformly, there exists no problem with respect to the non-uniformity of temperature. Further, even if the quantity of radiation heat increases, since the vicinity of the light source will not be heated up to a high temperature locally, it is possible to supply a large quantity of heat to the fluid and further to set the target temperature at a high value. With this device, however, when using as the working fluid a substance having an extremely low light absorbability, it is difficult to heat the fluid by the radiation heat.

OBJECTS OF THE INVENTION

One, object of the present invention is to provide a multi-temperature control system for controlling temperatures at a plurality of places using circulation of a working fluid, which is able to control each temperature at each place accurately without increasing the system size and the quantity of the working fluid to be used.

Another object of the present invention is to provide a fluid temperature control device which is preferably applicable to the above described small-sized multi-temperature control system.

A further object of the present invention is to provide a fluid temperature control device which is simple in structure, less in fluid temperature non-uniformity, and able to heat a fluid having a low light absorbability.

SUMMARY OF THE INVENTION

The multi-temperature control system according to the first aspect of the present invention, in order to control temperatures at a plurality of places using circulation of a working fluid, comprises a plurality of temperature control machines each assigned to each of the places. Each temperature control machine assigned to each place is provided with a pair of fluid circulation pipes for circulating the working fluid which is exclusively for each place, and each machine controls the temperature of the working fluid within each pair of the fluid circulation pipes individually.

With this distributed or decentralized type system, each temperature control machine can be arranged in the vicinity of each place to which each machine is assigned. Therefore, the length of the fluid circulation pipes can be shortened, so that the quantity of the working fluid used can be reduced. As a result, it is possible to use a high performance working fluid such as GALDEN or FLUORINERT, which is high in cost but does not require any ionization instrument.

Each temperature control machine controls each dedicated working fluid for each place independently, and since the fluid circulation pipes is short, its heat loss is small and the temperature control response is high, so that an accurate temperature control operation can be achieved.

The size of each temperature control machine can be small, since each machine does not need large thermal capacity nor large power for circulating the working fluid, and does not consume large electric power. The small-sized temperature control machines can be arranged at a plurality of places separately, their fluid circulation pipes can be shortened and no ionization instrument is necessary, so that the overall size of the multi-temperature control system can be reduced.

The temperature control machines may use a cooling liquid in order to cool their working fluid. In this case, these machines can commonly use the same cooling liquid source, thus simplifying the construction of the cooling liquid system.

A preferred construction of the temperature control machine comprises: an inner vessel having an inner space for passing the working fluid; a heater arranged in the inner space; and an outer vessel surrounding the inner vessel and having an outer space for passing cooling water outside the inner vessel. In the above constructed temperature control machine, since the working fluid can be heated and cooled within the single vessel, the size of the temperature control machine can be reduced. It is preferable to use as the heater a lamp which radiates infrared rays. In the case that the infrared ray lamp is used, a large heating capacity can be obtained even if the lamp is small-sized, so that the size of the temperature control machine can be further reduced. The small-sized temperature control machines can be easily arranged to their assigned places separately.

The distributed type multi-temperature control system according to the present invention can be applied to a reaction processing apparatus having a plurality of process chambers such as the semiconductor processing apparatus. In this case, a dedicated temperature control machine used for only a single process chamber can be arranged in the vicinity of each process chamber. When a single process chamber has a plurality of temperature-controlled portions, a plurality of the temperature control machines each of which is dedicated to each of the temperature-controlled portions can be arranged in the vicinity of the process chamber. In this case, each dedicated temperature control machine can be arranged in the vicinity of each of the portions separately.

The fluid temperature control device according to the second aspect of the present invention comprises: a transparent cylinder; a lamp arranged within the transparent cylinder, for radiating infrared rays; a cylindrical vessel arranged so as to surround said transparent cylinder and having an inner space between said transparent cylinder and said cylindrical vessel; a fluid inlet port for passing a fluid into the inner space; a fluid outlet port for passing the fluid from the inner space; and inner fins arranged in the inner space in contact with an inner circumferential surface of said cylindrical vessel.

In the fluid temperature control device according to the present invention, the fluid flowing through the inner space can be heated by radiation heat emitted from the lamp. Since the radiation heat is utilized, the temperature non-uniformity is relatively small. Further, since the fins are arranged in the inner space, even if the fluid is a substance having an extremely low light absorbability, the radiation heat can be received by the fins and then transmitted to the fluid, so that the fluid of low light absorbability can be also heated.

In order to increase the heating efficiency and further to eliminate the temperature non-uniformity, it is preferable that the fins are arranged dispersively all over the inner space. Further, it is further preferable that the fins are arranged dispersively all over the inner space at substantially a uniform density.

In the case that the fluid is a substance having a somewhat high light absorbability, it is preferable that the fins are extending radially along radiation direction of the infrared rays from the lamp. In this case, since the infrared rays can be emitted to all over the fluid without being blocked by the fins, the fluid can be heated uniformly.

In order to reduce the pressure loss of the fluid caused by the fins, it is preferable that the fins are extending axially roughly along flow direction of the fluid.

Further, the fluid temperature control device according to the present invention may further comprise: an outer cylinder surrounding said cylindrical vessel and having an outer space between said cylindrical vessel and said outer cylinder; a cooling liquid inlet port for passing a cooling liquid into the outer space; and a cooling liquid outlet port for passing the cooling liquid from the outer space. With this device, the fluid can be not only heated but also cooled.

In this case, in order to increase the cooling efficiency and further to decrease the temperature non-uniformity during cooling, this device preferably further comprises outer fins arranged in the outer space in contact with an outer circumferential surface of the cylindrical vessel. It is preferable that the outer fins are arranged dispersively all over the outer space at a substantially uniform density.

The fluid temperature control device according to the present invention can be applied not only to the distributed type multi-temperature control system according to the present invention but also to other various temperature control applications.

The other features and the objects of the present invention will be clarified under the detailed description of the embodiments.

PREFERRED EMBODIMENTS OF THE INVENTION

Figure 4:
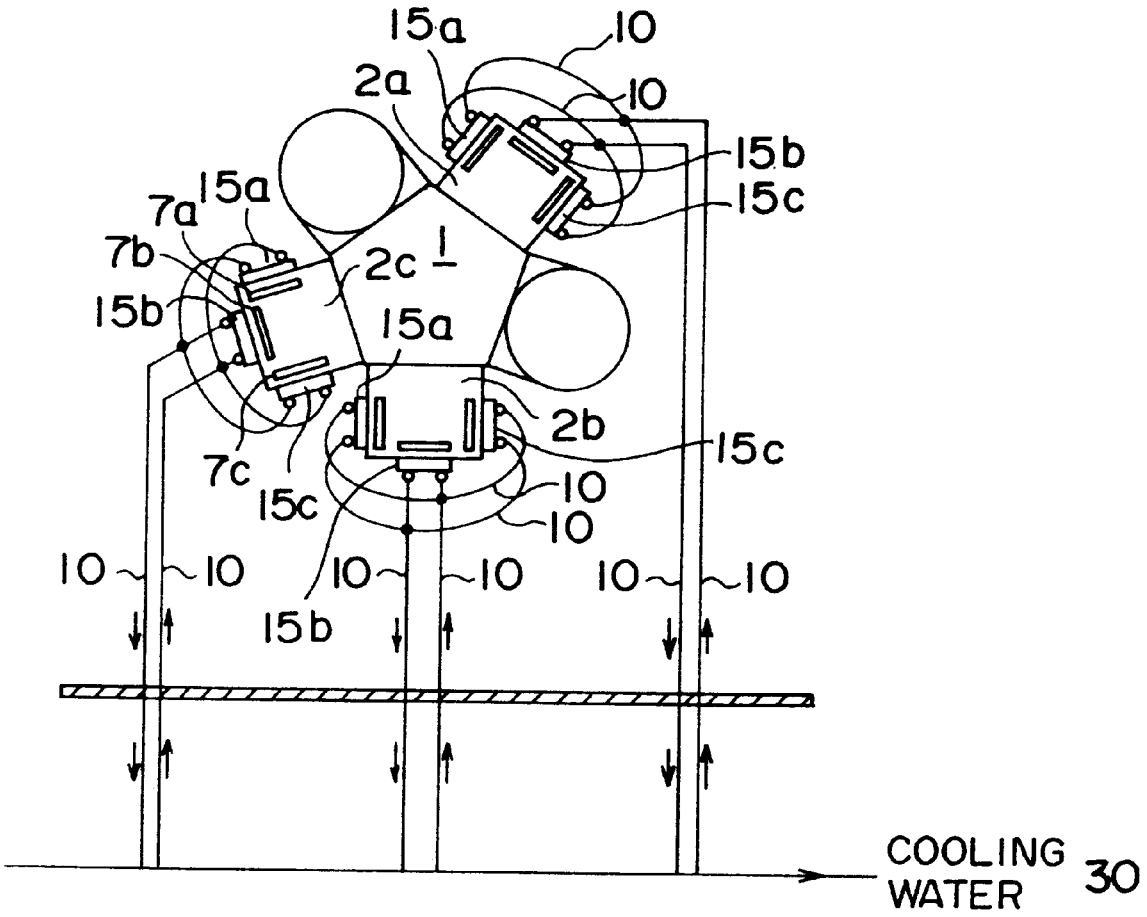
FIG. 4 is a plane view showing the semiconductor processing apparatus which uses an embodiment of the temperature control system according to the present invention.

FIG. 4 shows an entire construction of an embodiment of the multi-temperature control system according to the present invention, which is applied to the semiconductor processing apparatus. Here, since the semiconductor processing apparatus is substantially the same as the prior art apparatus shown in FIGS. 1 and 2, the same reference numerals have been retained for similar elements or parts having the same functions as with the case of the prior art apparatus, without repeating the similar description thereof.

As shown in FIG. 4, a set of three small-sized temperature control machines 15*a*, 15*b* and 15*c* are provided for each of the three process chambers 2*a*, 2*b* and 2*c* of the semiconductor processing apparatus, respectively. In other words, one set of three temperature control machines 15*a*, 15*b* and 15*c* are provided for the first process chamber 2*a*. In the same way, another set of three temperature control machines 15*a*, 15*b* and 15*c* are provided for the second process chamber 2*a*and a further other set of three temperature control machines 15*a*, 15*b* and 15*c* are provided for the third process chamber 2*c*.

Each of the temperature control machines 15*a*, 15*b* and 15*c* is provided with its' own fluid circulation pipes (not shown in FIG. 4) independently from the other temperature control machines, to supply a working fluid such as FLUORINERT to each of the process chambers 2*a*, 2*b* and 2*c*, independently. Each of the temperature control machines 15*a*, 15*b* and 15*c* supplies the working fluid to only the process chamber on which each machine is mounted, without supplying the working fluid to the other process chambers. Further, in the three temperature control machines 15*a*, 15*b* and 15*c* mounted on one process chamber, the first temperature control machine 15*a* supplies the working fluid to the pipe line 7*a* of the chamber wall 3 (shown in FIG. 2); the second temperature control machine 15*b* supplies the working fluid to the pipe line 7*b* of the chamber cover 4; and the third temperature control machine 15*c* supplies the working fluid to the pipe line 7*c* of the wafer support base 6, respectively. In summary, a single temperature control machine is assigned exclusively to each portion at which temperature is to be controlled in the semiconductor processing apparatus.

These temperature control machines 15*a*, 15*b* and 15*c* can be mounted on outer wall surfaces of the process chambers, for instance;. without being limited to only the outer wall surfaces thereof, however, the temperature control machines can be preferably disposed at such positions as are close to each of the process chambers so that the length of each fluid circulation pipe is enough short. From the same point of view, it is preferable that each of the temperature control machines 15*a*, 15*b* and 15*c* is disposed at such position as is as close as possible to each of the pipe lines 7*a*, 7*b* and 7*c*.

These nine temperature control machines 15*a*, 15*b* and 15*c* are connected to a common cooling liquid source 30 via a pair of different cooling liquid circulation pipes 10. As the cooling liquid, water can be used, for instance; however, another substance can be of course used.

Figure 5:
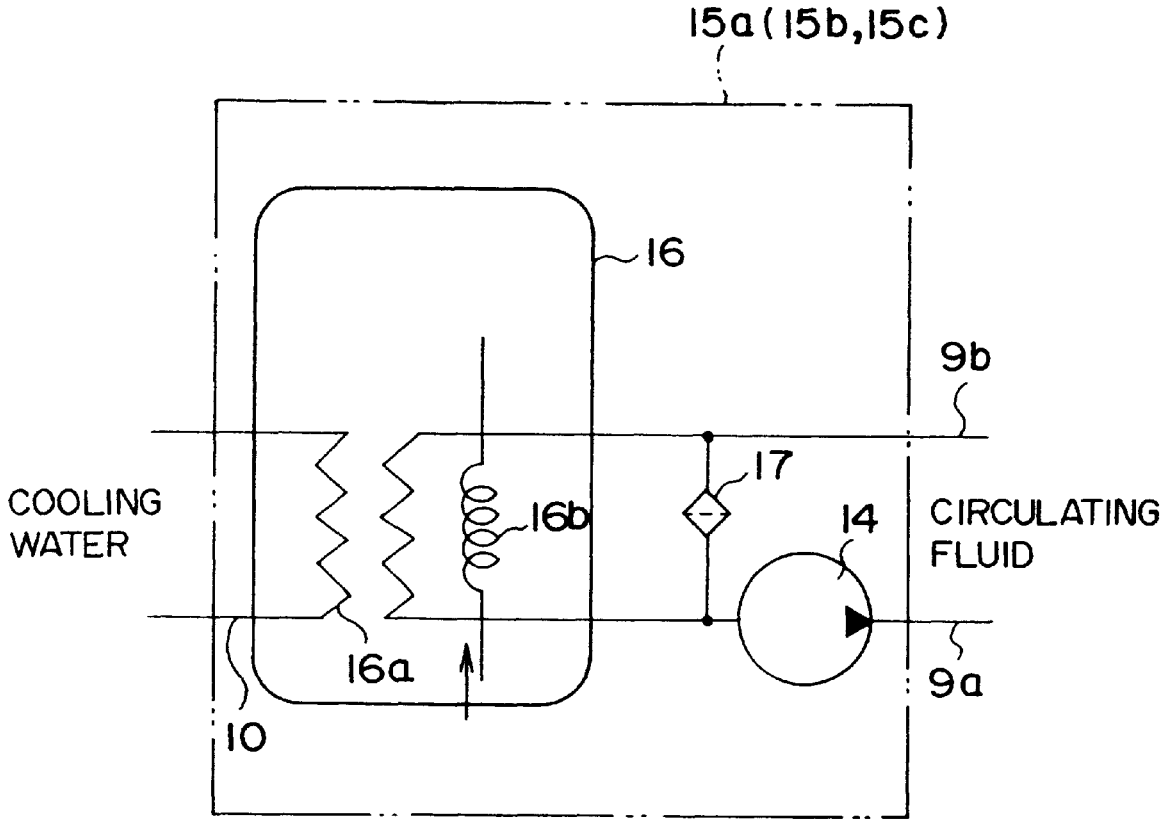
FIG. 5 is a circuit diagram of the temperature control machine used for the embodiment shown in FIG. 4.

All of the temperature control machines 15*a*, 15*b* and 15*c* are of the substantially same construction. As shown in FIG. 5, each temperature control machine is provided with a fluid temperature control device 16 for heating and cooling the working fluid and a pump 14 for circulating the working fluid through the fluid circulation pipes 9*a* and 9*b*. The fluid temperature control device 16 is composed of a cooling section 16*a* for cooling the working fluid by cooling water and a heating section 16*b* for heating the working fluid. In the case that ethylene glycol or water is used as the working fluid, a deionizing instrument 17 is connected between the supply pipe (9*a*) and the return pipe (9*b*) of the fluid circulation pipes 9*a* and 9*b*. In the case that the non-active substance such as FLUORINERT is used as the working fluid, the deionizing instrument 17 is not required.

Figure 6:
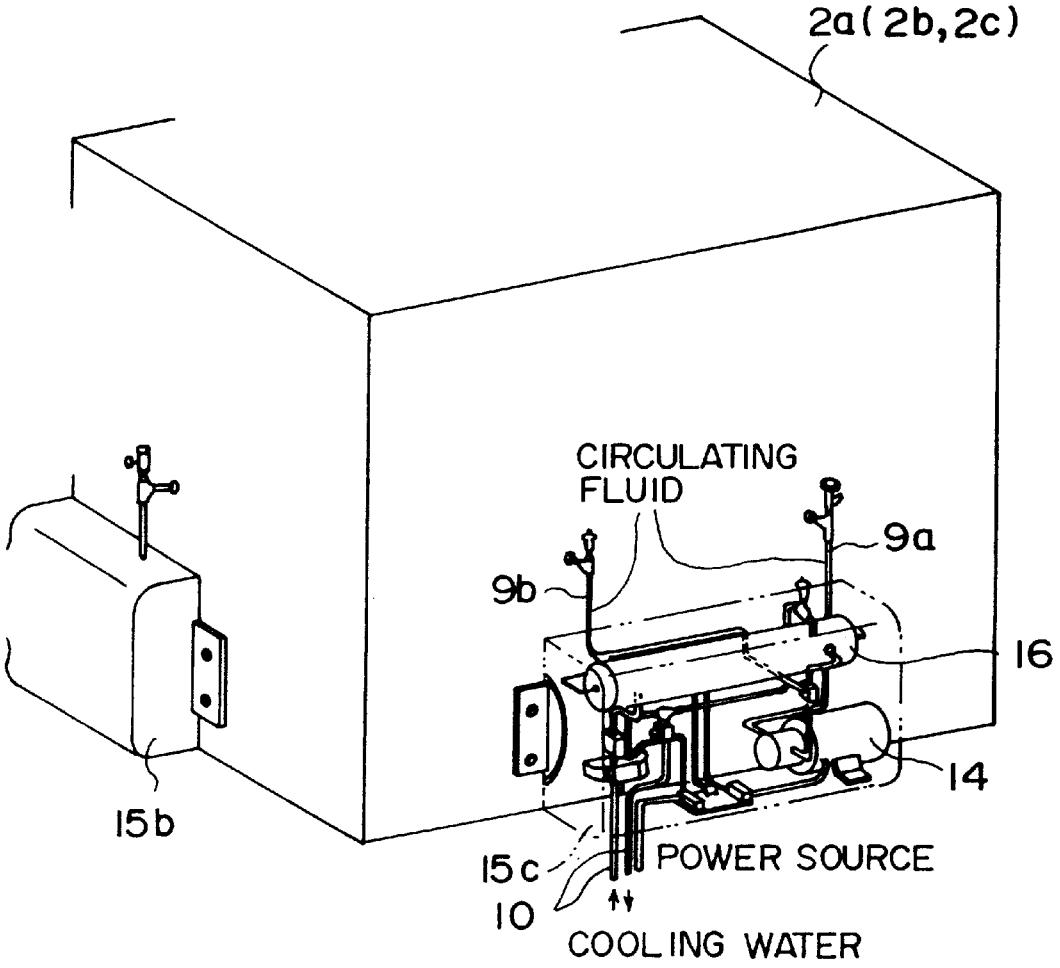
FIG. 6 is a perspective view showing the mounting example of the temperature control machines of the same embodiment.

FIG. 6 shows a method of mounting each of the temperature control machines 15*a*, 15*b* and 15*c* on each of the process chambers 2*a*, 2*b* and 2*c*.

Figure 2:
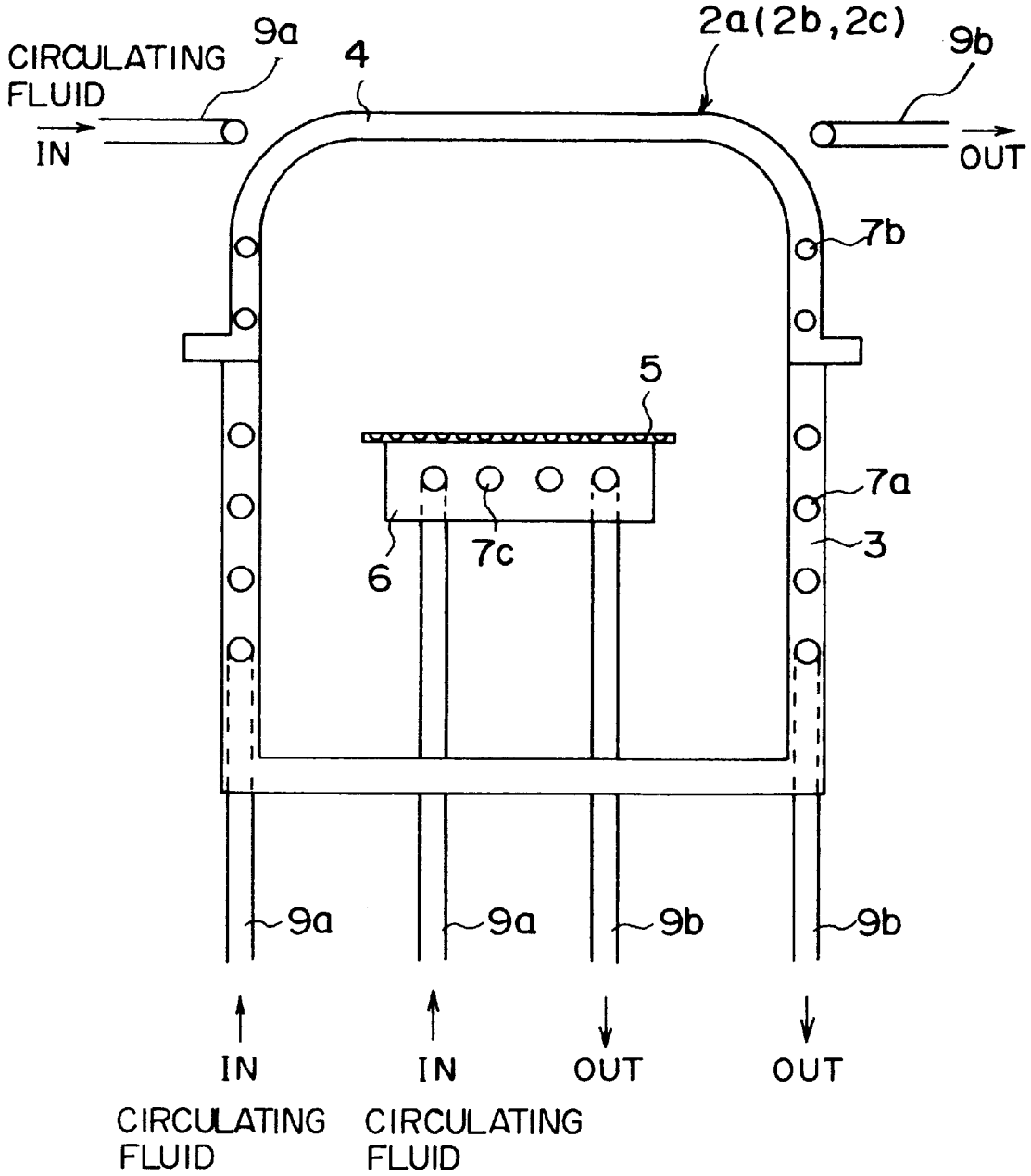
FIG. 2 is a cross-sectional view showing the structure of the process chamber.
Figure 3:
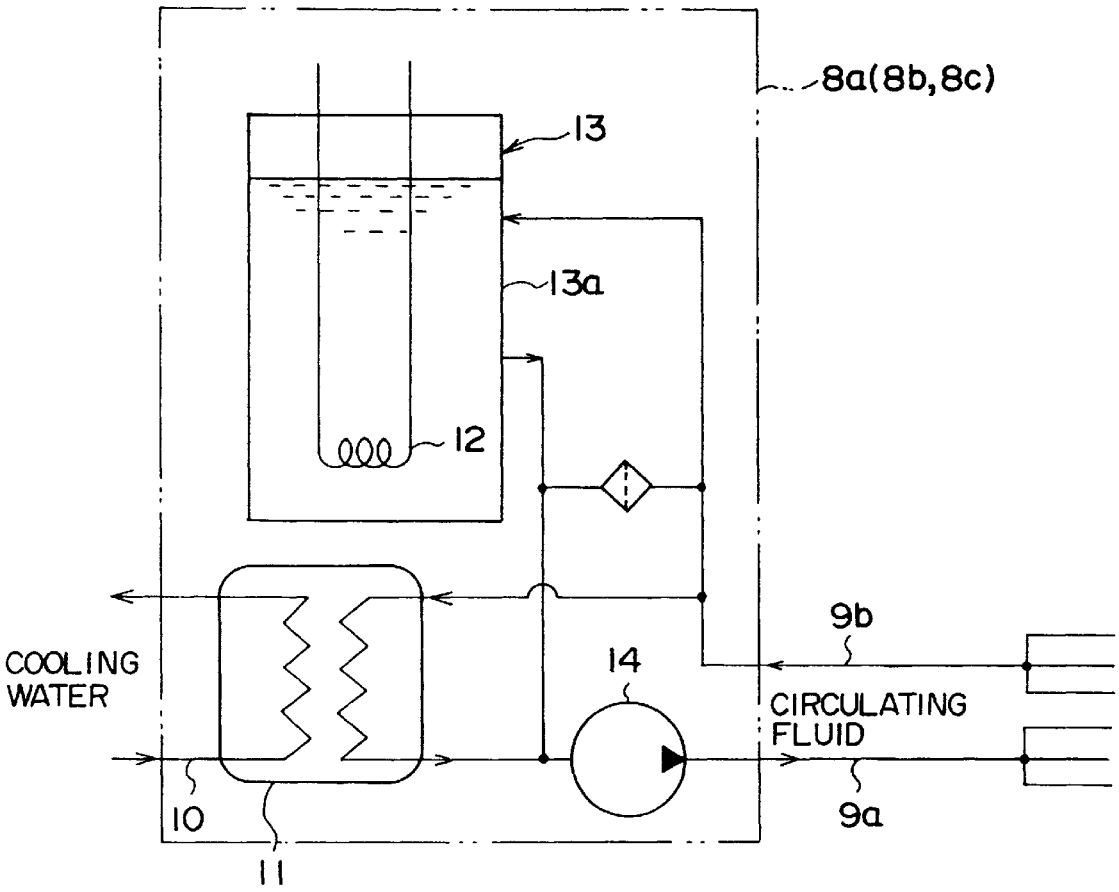
FIG. 3 is a circuit diagram of the prior art temperature control machine.

As shown, the temperature control machines 15*a*, 15*b* and 15*c* are fixed to the outer surfaces of the side walls of each of the process chamber 2*a*, 2*b* and 2*c*, respectively. Each pair of fluid circulation pipes 9*a* and 9*b* extending from each of the temperature control machines 15*a*, 15*b* and 15*c* are introduced into the side wall of the process chamber, and then connected to each of the pipe lines 7*a*, 7*b* and 7*c* as shown in FIG. 2, respectively.

A pair of cooling liquid circulation pipes 10 extend from each temperature control machine 15*a*, 15*b* and 15*c*. As shown in FIG. 4, these cooling liquid circulation pipes from the temperature control machine 15*a*, 15*b* and 15*c* are arranged together to be one pair of pipes for each chamber which are connected to a common cooling liquid source 30. Alternatively, it is possible to connect each cooling liquid circulation pipe 10 of each temperature control machine to the common cooling liquid source 30 directly. In the case that the target temperatures of the three temperature control machines 15*a*, 15*b* and 15*c* are different from each other for instance, it is also possible to connect the cooling liquid circulation pipes of the three temperature control machines 15*a*, 15*b* and 15*c* in series so that the cooling water flows through these pipes in order in the following manner: the cooling water first flows from the cooling liquid source 30 into the temperature control machine of the lowest target temperature, secondly is passed through the temperature control machine of the medium target temperature, and lastly through the temperature control machine of the highest target temperature to be returned to the cooling water source 30.

Although the cooling liquid is used in common for a plurality of the temperature control machines 15*a*, 15*b* and 15*c*, as described above, as far as the flow rate of the cooling liquid is not excessively slow, the temperature fluctuations of the cooling liquid is small. Further, even if the temperature of the cooling liquid fluctuates slightly, since each temperature control machine 15*a*, 15*b* or 15*c* can control the temperature to the optimum conditions individually, it is possible to control each temperature of each working fluid accurately.

Further, without being limited only to the side walls of the process chamber, the temperature control machines 15*a*, 15*b* and 15*c* can be mounted on the bottom wall or the top wall or the adjacent floor, etc.; that is, at any places in the vicinity of the process chamber at which the fluid liquid circulation pipes can be shortened sufficiently. For example, In another embodiment shown in FIG. 7, a shelf 18 is provided on a flank of a housing shell 17 of the semiconductor processing apparatus which has a plurality of the processing chambers 2*a*, 2*b* and 2*c*, and a plurality of the temperature control machines 15*a*, 15*b* and 15*c* are mounted on the shelf 18 in a row. Each pair of the fluid circulation pipes 9*a*, 9*b*, 9*c*, 9*d*, 9*e* and 9*f* extending from each of the temperature control machines 15*a*, 15*b* and 15*c* are introduced into the inside of the housing shell 17 to be connected to each of the pipes 7*a*, 7*b* and 7*c*, as shown in FIG. 2, of the processing chambers 2*a*, 2*b* and 2*c*. In this embodiment, the temperature control machines 15*a*, 15*b* and 15*c* are arranged in the vicinity of the semiconductor processing apparatus, so that their fluid circulation pipes 9*a*, 9*b*, 9*c*, 9*d*, 9*e* and 9*f* are sufficiently short and the temperatures of the working fluids in these pipes can be controlled accurately.

In the above embodiments, each temperature control machine controls the temperature at only one place of the one processing chamber; without being limited only to this, however, each temperature control machine may control the temperature of a plurality of places in the semiconductor processing apparatus. Further, in the above-mentioned embodiment, although all the portions of all the process chambers are controlled by the circulating working fluid, it is also possible to control the temperatures of some portions by another method without using the working fluid. For instance, in the case that there exists a chamber or a portion to be heated up to a temperature higher than 100° C., an infrared ray lamp can disposed at this chamber or this portion, instead of the above-mentioned temperature control machine, so that this infrared lamp heats the chamber or the portion directly.

Figure 8:
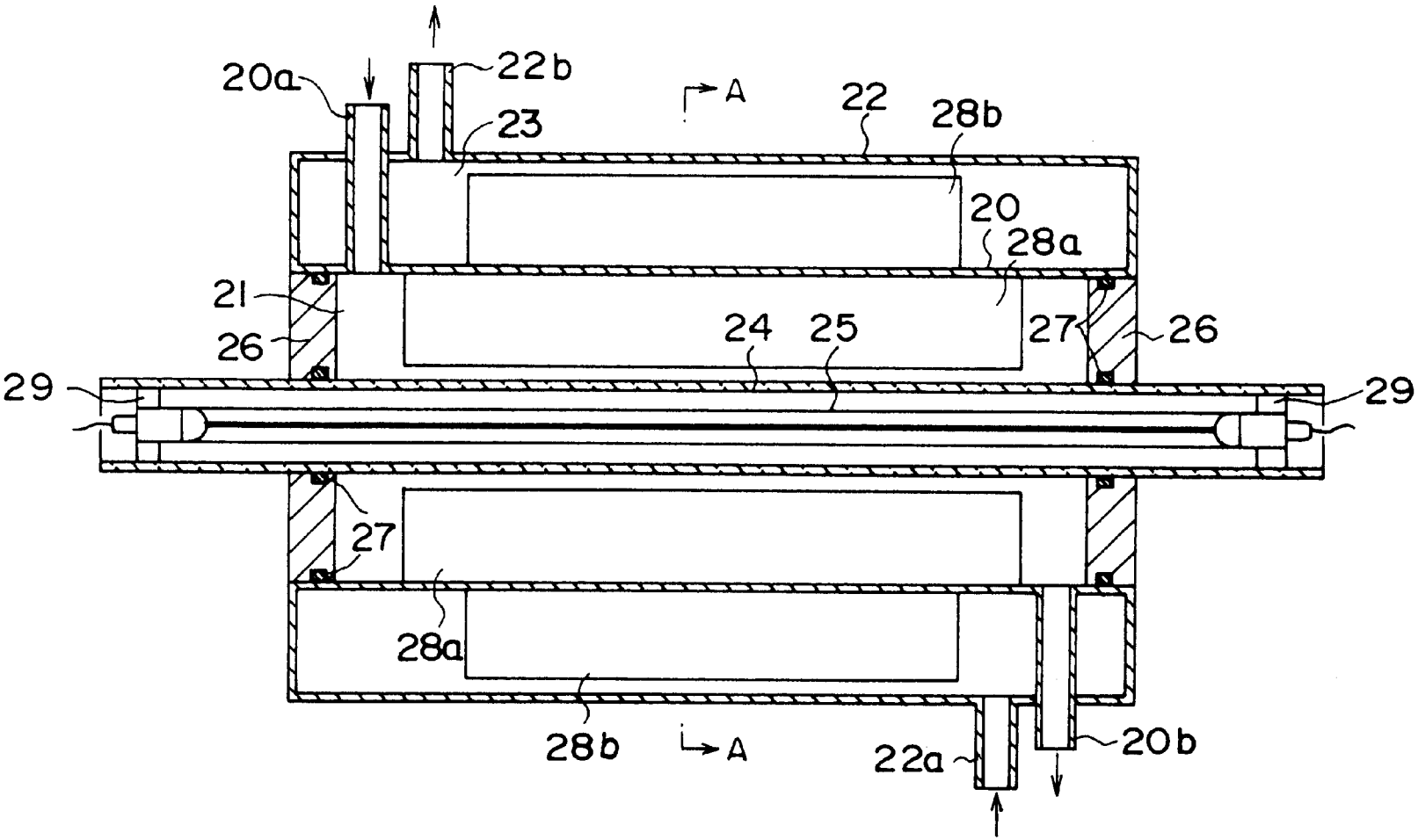
FIG. 8 is a longitudinal cross-sectional view showing the fluid temperature control device used for the temperature control machine shown in FIG. 5.
Figure 9:
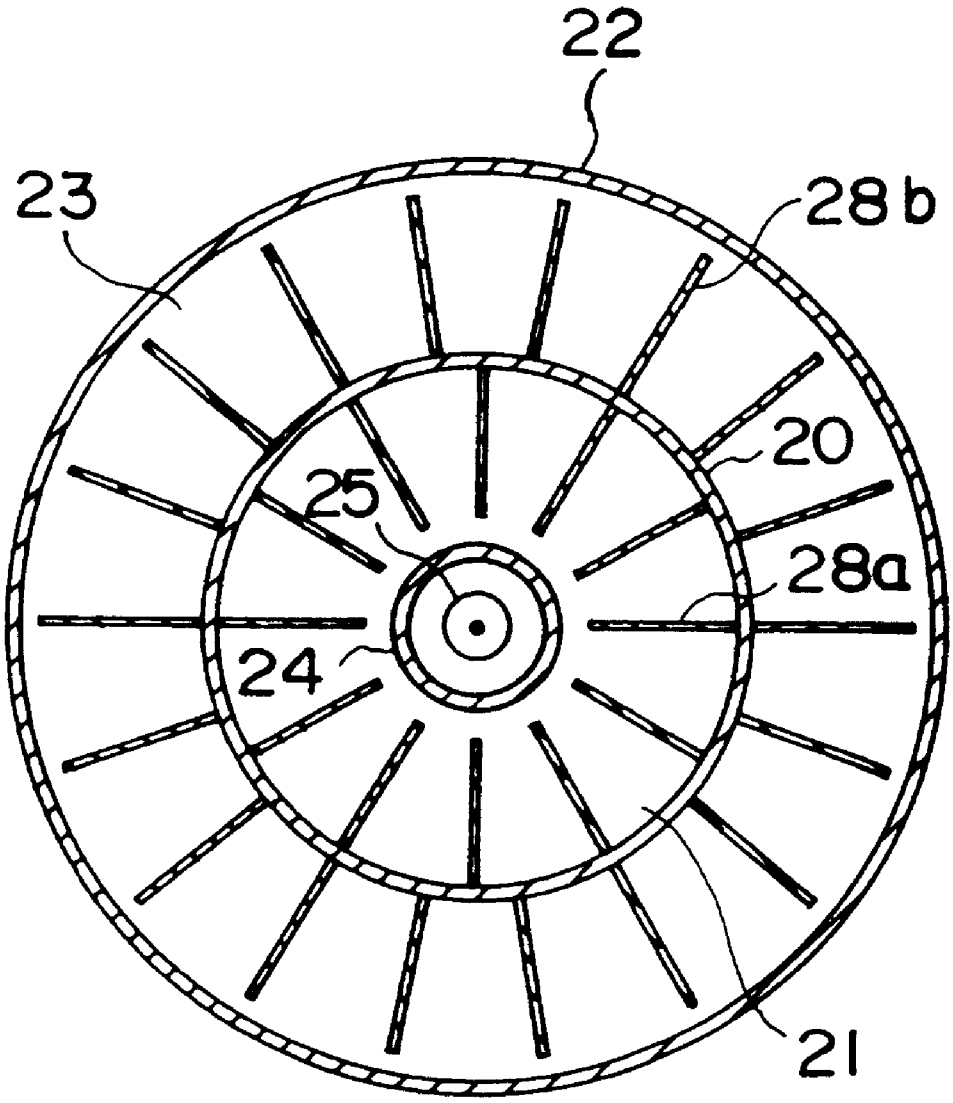
FIG. 9 is a cross-sectional view taken along the line A—A in FIG. 8.

FIGS. 8 and 9 show a embodiment of the fluid temperature control device 16 shown in FIG. 5. FIG. 8 is a longitudinal cross-sectional view showing the same device and FIG. 9 is a lateral cross-sectional view taken along the line A—A in FIG. 8.

As shown in these drawings, the fluid temperature control device 16 has two large (outer) and small (inner) cylindrical vessels 20 and 22. The inner vessel 20 is formed with an inner space 21 and two closed end surfaces. The outer vessel 22 is formed with an outer space 23 enclosing the inner vessel 20 and two closed end surfaces. Further, the inner vessel 20 is formed with a working fluid inlet port 20*a* at a position close to one end of the circumferential wall thereof and with a working fluid outlet port 20*b* at a position close to the other end of the circumferential wall thereof in such a way that two ports 20*a* and 20*b* are arranged symmetrically opposite to each other with respect to the central axis thereof. In the same way, the outer vessel 22 is formed with a cooling liquid inlet port 22*a* at a position close to one end of the circumferential wall thereof and with a cooling liquid outlet port 22*b* at a position close to the other end of the circumferential wall thereof in such a way that two ports 22*a* and 22*b* are arranged symmetrically opposite to each other with respect to the central axis thereof.

The inner vessel 20 is made of a material having an excellent corrosion resistance, an excellent thermal conductivity and an excellent moldability, for instance such as aluminum, copper, stainless steel, etc. The outer vessel 22 can be made of the same material or another material having an excellent corrosion resistance but a low thermal conductivity such as plastic, vinyl chloride, ceramics, etc. The junction portions between the inner vessel 20 and outer vessels 22 are sealed by welding or soldering or other appropriate method so as not to leak the cooling liquid.

Within the inner space 21 of the inner vessel 20, a transparent cylinder 24 is arranged along the central axis thereof so as to pass through both the end walls 26 of the inner vessel 20. A heating lamp 25 is inserted into the transparent cylinder 24. The transparent cylinder 24 is made of a material having an extremely high light transmissibility and a high heat resistance such as quartz glass. As the heating lamp 25, the lamp which can emit a great quantity of infrared rays is preferable. For instance, a heating halogen lamp is used. The heating lamp 25 is supported by two bushes 29 within the transparent cylinder 24 at the central position thereof in such a way as not to be brought into contact with the transparent cylinder 24.

The two end walls 26 of the inner vessel 20 are made of a material having an appropriate elasticity and a sufficient heat resistance such as a hard rubber, plastic, metal, etc. Further, two large- and small-diameter sealing members 27 such as O-rings are disposed on both the inner and outer circumferential surfaces of the two end walls 26, respectively in order to seal the gaps between the end walls 26 and the inner vessel 20 and between the end walls 26 and the transparent cylinder 24.

A plurality of inner fins 28*a* are fixed on the inner circumferential surface of the inner vessel 20, and a plurality of outer fins 28*b* are fixed on the outer circumferential surface of the inner vessel 20. The inner and outer fins 28*a* and 28*b* extend in a direction crossing a flow direction (substantially parallel to the central axis of the vessel 20) of the working fluid and the cooling water at an appropriate angle so that good thermal exchange efficiencies between the inner fins 28*a* and the working fluid and between the outer fines 28*b* and the cooling water are obtained. Further, the inner fins 28*a* extend in the radial direction of the inner space 21, that is, in the radiation direction of the infrared rays of the lamp 25. However, when using the working fluid having a low light absorbability, the inner fans 28*a* may extend in a direction crossing the radiation direction of the infrared rays. In the same way, the outer fins 28*b* extend in the radial direction of the inner space 21. However, this arrangement of the outer fins 28*b* is not necessarily required. The inner fins 28*a* are arranged being separated at regular angular intervals (i.e., at substantially uniform arrangement density) all over the inner space 21, and the outer fins 28*b* are also arranged being separated at regular angular intervals all over the outer space 23. These fins 28*a* and 28*b* are made of a material having a high thermal conductivity and excellent corrosion resistance and moldability such as aluminum, copper, stainless steel, etc. Further, it is preferable that the material has a high absorbability of infrared rays.

There exists a slight gap between each end of each of the inner fins 28*a* and the outer circumferential surface of the transparent cylinder 24. In the same way, there exists a slight gap between each end of each of the outer fins 28*b* and the inner circumferential surface of the outer vessel 22.

In the fluid temperature control device constructed as described above, the working fluid flows from the inlet port 20*a* to the output port 20*b* through the inner space 21, and the cooling liquid flows from the inlet port 22*a* to the output port 22*b* through the outer space 23.

When a target temperature (e.g., 100° C.) of the working fluid is higher than the temperature (e.g., 25° C.) thereof at the inlet port 20*a*, the lamp 25 is turned on. In this case, the cooling liquid is stopped from flowing in general. The infrared rays emitted from the lamp 25 are allowed to be incident upon the inner space 21 through the transparent cylinder 24. Here, if the working fluid is a substance having an extremely low light absorbability (e.g., FLUORINERT), a major part of the emitted infrared rays are absorbed by the fins 28*a*. Therefore, the radiated heat is transmitted from the fins 28*a* to the working fluid, so that the working fluid can be heated. Here, if the working fluid is a substance having an appropriate light absorbability (e.g., water, ethylene glycol, etc.), the emitted infrared rays are absorbed by not only the fins 28*a* but also by the working fluid itself directly, so that the working fluid can be heated by the radiated heat.

The heat quantity of the lamp 25 can be controlled by a combination of a temperature sensor at the outlet port 20*b* and a controller (both not shown). In this case, the duty factor (turn-on time) and/or the light emission quantity of the lamp 25 are adjusted. For instance, the power supplied to the lamp 25 is feedback controlled so that the temperature of the working fluid becomes equal to the target temperature at the outlet port. When the outlet temperature exceeds the target temperature due to an excessive heating or an external factor, the lamp 25 is turned off, and, if not sufficient by only turning off the lamp, the cooling liquid is passed.

When the target temperature (e.g., 30° C.) is lower than the temperature (e.g., 80° C.) of the working fluid at the inlet port, the cooling liquid is passed, and the lamp 25 is turned off in general. Therefore, the heat of the working fluid is transmitted to the cooling liquid through the inner fins 28*a*, the inner vessel 20 and the outer fins 28*b*, so that the working fluid can be cooled. The flow rate of the cooling liquid can be controlled by the above-mentioned controller to match the outlet temperature of the working fluid with the target temperature. Further, when the outlet temperature of the working fluid drops below the target temperature by the excessive cooling, the lamp 25 is turned on or the flow rate of the cooling liquid is reduced.

As described above, it is possible to control the temperature of the working fluid to the target temperature by controlling the turn-on time of the lamp 25 and the flow rate of the cooling liquid by the controller, that is, by properly heating and/or cooling the working fluid.

As understood by the above description, the working fluid is heated mainly by the radiation heat of infrared rays. The radiation heat can be supplied uniformly to any light absorbing substances existing at any places in the inner space 21 owing to its inherent nature, irrespective of the distance from the lamp 25. In addition, since the inner fins 28*a* are arranged so as to extend in the radiation direction of the infrared rays from the lamp 25 within the inner space 21, the infrared rays can be allowed to be incident upon all the places within the inner space 21 without being obstructed by the inner fins 28*a*. As a result, in the case that such a substance as water which can absorb the light appropriately is used as the working fluid, the fluid can be heated substantially uniformly by receiving the radiation heat at all the places within the inner space 21, so that the fluid temperature rises uniformly. Further, in the case that such a substance as FLUORINERT which can hardly absorb light is used as the working fluid, since the inner fins 28*a* arranged in a uniform density all over the inner space 21 receive the radiation heat uniformly at all the places and then transmit the radiation heat to the working fluid, the fluid can be heated roughly uniformly.

As described above, since the radiation heat from the lamp 25 is supplied to almost all the working fluid roughly uniformly within the inner space 21, the heat will not be centralized at any specific local position. Further, since a space is formed between the lamp 25 and the transparent cylinder 24, it is possible to avoid heating up partially the transparent cylinder 24 and the fluid flowing near the transparent cylinder 24 by the thermal conduction. Owing to the above-mentioned facts, it is possible to increase the heat capacity of the lamp 25 to a fairly large value, with the result that a large heating capability can be obtained in spite of a small size of the lamp.

Further, since a gap is formed between the outer fins 28*b* and the outer vessel 22, it is possible to prevent radiation heat within the inner vessel 20 from being dissipated from the outer fins 28*b* to the outer vessel 22 directly, so that the heating efficiency can be preferably improved. From the same point of view, it is also preferable to make the outer vessel 22 of a material having a low thermal conductivity such as ceramics or plastic. However, as far as no problem arises on the heating efficiency, the outer fins 28*b* can be in contact with the outer vessel 22 and the outer vessel 22 can be made of a material having a high thermal conductivity (e.g., the same material as the inner vessel 20).

The working fluid is cooled by the thermal conduction through the inner and outer fins 28*a* and 28*b*. Since the fins 28*a* and 28*b* are arranged roughly in a uniform density all over the inner and outer spaces 21 and 23, respectively, the cooling efficiency is high and the temperature non-uniformity due to the thermal conductivity is small. Further, since there exists the gap between the outer fins 28*b* and the outer vessel 22, the outer fins 28*b* are not subjected to the influence of the external temperature, this is preferable from the standpoint of cooling efficiency.

In assembly of the fluid temperature control device 16, the transparent cylinder 24 is inserted into the inner space 21. Further, in maintenance, the transparent cylinder 24 is pulled out of or inserted again into the inner space 21. In these insertion and removal works, since there exists a gap between the transparent cylinder 24 and the inner fins 28*a*, these works can be made smoothly. Of course, the inner fins 28*a* can be brought into contact with the transparent cylinder 24, as far as no problem arises.

Figure 7:
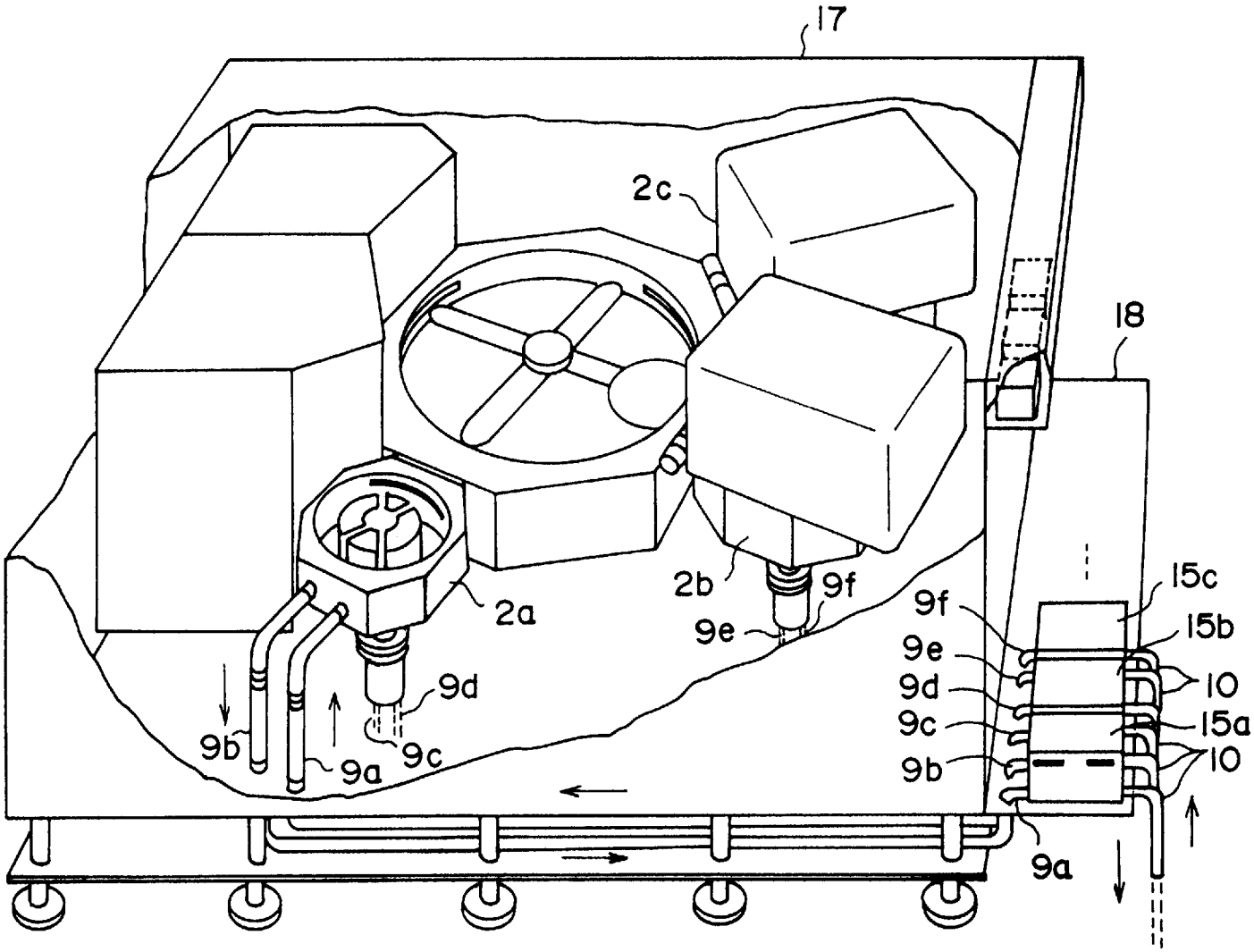
FIG. 7 is a perspective view showing another mounting example of the temperature control machines.

As described above, the fluid temperature control device 16 according to the present invention has a large heating and cooling capability for its size. Therefore, this device can be fairly small-sized. Further, since the working fluid can be heated to the target temperature uniformly, the temperature control precision is relatively high. As a result, each of the temperature control machines 15*a*, 15*b* and 15*c* can be small-sized, while keeping the temperature precision at a high level. Therefore, the small-sized temperature control machine 15*a*, 15*b* or 15*c* can be mounted separately on the process chamber 2*a*, 2*b* or 2*c*, or mounted together on the housing shell of the semiconductor processing apparatus as shown in FIG. 7.

Figure 10:
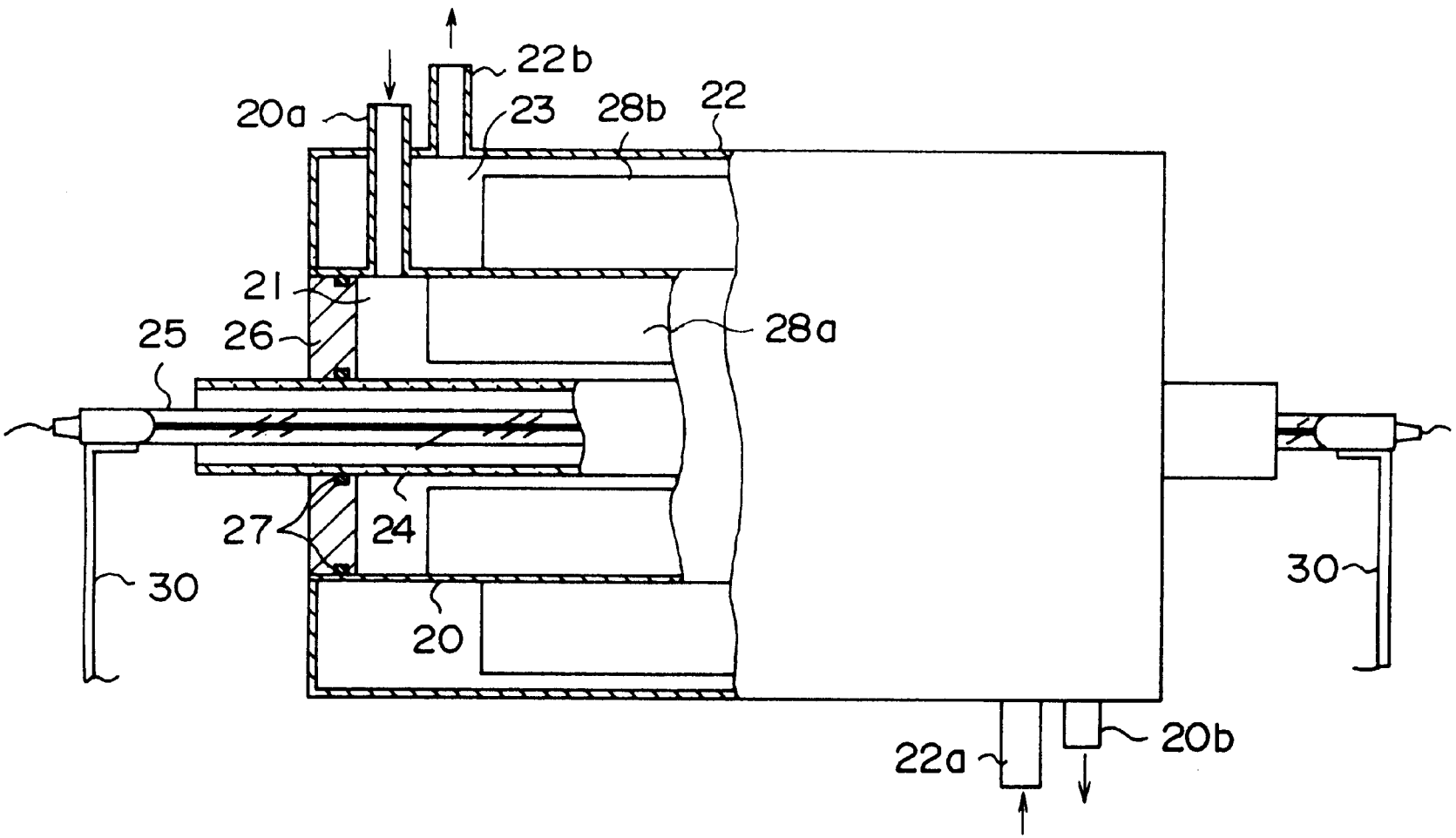
FIG. 10 is a partial cross-sectional view showing a modification of the lamp supporting portion of the fluid temperature control device.

In the practical construction of the fluid temperature control device 16 according to the present invention, various modifications can be made. For instance, as shown in FIG. 10, the heating lamp 25 can be supported by a bracket 30 attached to the outside of the transparent cylinder 24. The bracket 30 may be mounted at an appropriate position such as the outer vessel 22 of this control device or a fixture other than this control device.

Figure 11:
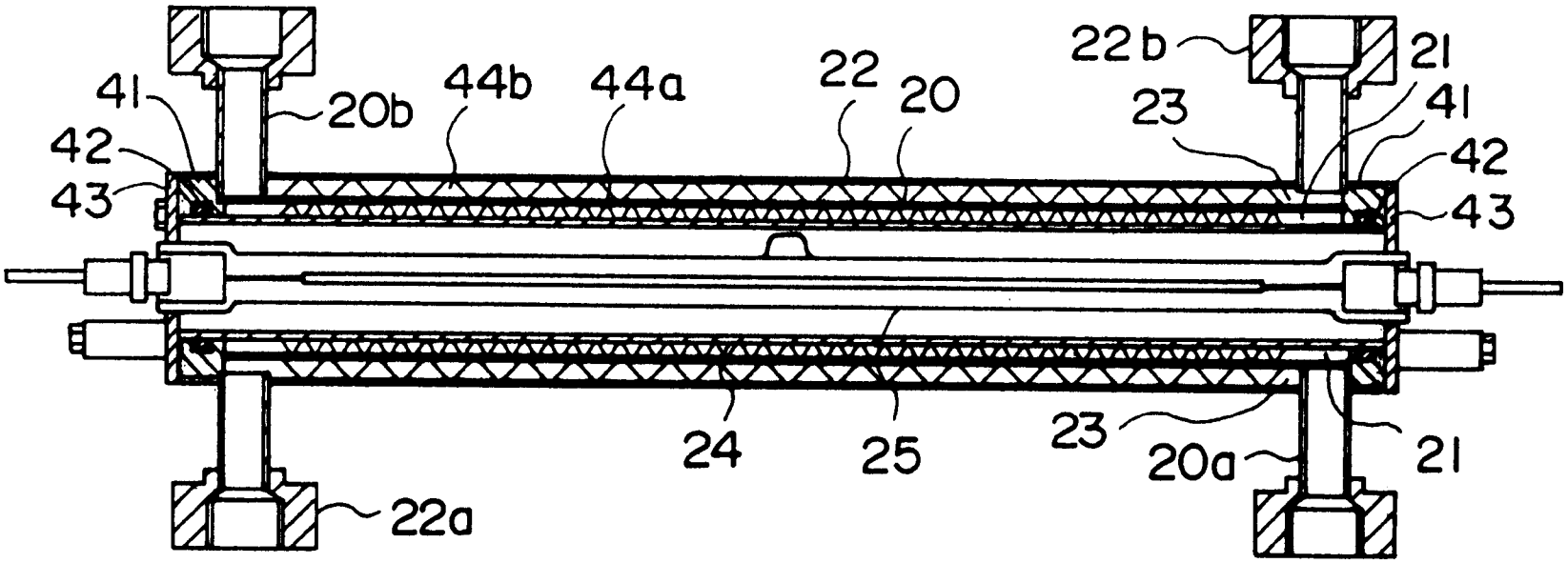
FIG. 11 is a longitudinal cross-sectional view showing another embodiment of the fluid temperature control device.

FIG. 11 shows another embodiment of the fluid temperature control device in which the cylindrical inner vessel 20 is inserted into the cylindrical outer vessel 22 coaxially with the outer vessel 22, and two doughnut-shaped bushes 41 are attached to both ends of the outer vessel 22. These bushes 41 close the outer space 23 by the side surfaces thereof and further support the transparent cylinder 24 by the inner circumferential surfaces thereof. Two junction portions between the bushes 41 and the transparent cylinder 4 are sealed by two O-rings 42, respectively. Two circular outer bushes 43 each having a central hole are fixed to the outer side surfaces of the bushes 41 mounted on both ends of the outer vessel 22 by use of screws, respectively. The side surfaces of the outer bushes 43 are in contact with both end surfaces of the transparent cylinder 24, to support the heating lamp 25 by the inner circumferential surfaces thereof.

There exists a sufficient gap between the transparent cylinder 24 and the lamp 25, so that the transparent cylinder 24 will not be heated to a locally high temperature by the conductive heat from the lamp 25.

The inlet port 20*a* of the working fluid and the inlet port 22*a* of the cooling liquid are arranged on both opposite ends of the device. Therefore, the working fluid and the cooling liquid flow in mutually opposite directions. In this case, generally the cooling efficiency is excellent, as compared with the case that the working fluid and the cooling liquid flow in the same direction.

As shown by two triangular symbol marks in FIG. 11, inner fins 44*a* and outer fins 44*b* are fixed to all over the surfaces of both the inner and outer circumferential surfaces of the inner vessel 20. A slight gap is formed between the ends of the inner fins 44*a* and the transparent cylinder 24 and between the ends of the outer fins 44*b* and the outer vessel 22, respectively, for the reason as already explained.

Figure 12A:
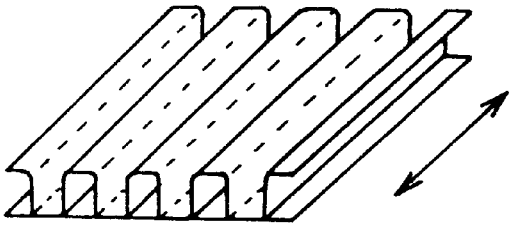
FIGS. 12(A) to 12(G) are perspective views showing various types of fins.
Figure 12B:
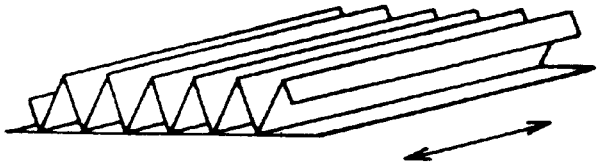
Figure 12C:
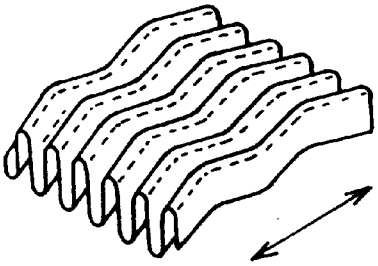
Figure 12D:
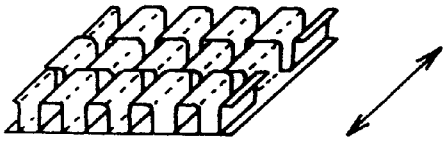
Figure 12E:
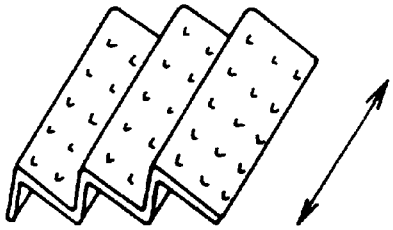
Figure 12F:
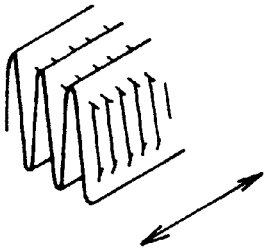
Figure 12G:
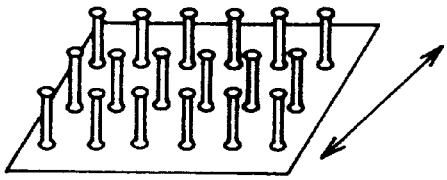

As these fines 44*a* and 44*b*, various types as shown in FIGS. 12(A) to 12(G) can be adopted. FIG. 12(A) shows the fines manufactured by bending a thin plate into a corrugated shape rectangular in cross section. FIG. 12(B) shows the fines manufactured by bending a thin plate into a corrugated shape rectangular in cross section. FIG. 12(C) shows the fines manufactured by bending a thin plate into a corrugated shape ridged in cross section and further undulating the ridged portions. FIG. 12(D) shows the fines manufactured by bending a plurality of narrow thin plates into a corrugated shape rectangular in cross section and further arranging them as their corrugated portions are shifted alternately with each other. FIG. 12(E) shows the fines manufactured by bending a thin plate into a corrugated shape in cross section and further forming a plurality of fine recessed or projected portions on the surface thereof. FIG. 12(F) shows the fines manufactured by bending a thin plate into a corrugated shape rectangular in cross section and further forming louver-shaped cutout portions on the surface thereof. FIG. 12(G) shows the fines of a number of pins. In FIGS. 12(A) to 12(G), each arrow shows a direction parallel to the central axis of the inner vessel 20; that is, a flow direction of the fluid or the cooling liquid. The arrangements of the fines with the specific relations to the flow directions as shown in these drawings allow the fluid or the cooling liquid flow smoothly without being blocked by the fines.

The inner fines 44*a* and the outer fins 44*b* are arranged dispersively all over the inner space 21 and the outer space 23 at a substantially uniform density, respectively, so that these fines 44*a* and 44*b* act on the fluid and the cooling liquid uniformly all over the places within the inner and outer spaces 21 and 23, respectively. Therefore, the fluid can be heated and cooled by these fines effectively without producing any temperature non-uniformity. From this point of view, it is preferable that the arrangement density of the fins 44*a* or 44*b* is as high as possible, unless the pressure loss of the working fluid or the cooling liquid caused by the fins causes a problem.

Any fins as shown in FIGS. 12(A) to 12(G) are suitable for the inner fines 44*a* because the fins themselves absorb infrared rays and receive the radiation heat effectively. In the case that the working fluid has an extremely small light absorbability, the major part of the infrared rays of the lamp are absorbed by the fins to be converted to heat by repeating the following process as: the infrared rays are allowed to be incident upon any places of the fins, absorbed partially, and reflected partially; and the reflected rays are allowed to be incident upon other places of the fins, absorbed and reflected partially, . . . As a result, the fluid can be heated effectively and uniformly.

On the other hand, In the case that the working fluid absorbs light considerably as with the case of water, the pin type fines as shown in FIG. 12(G) can be adopted with no problem, since the infrared rays can be are transmitted to all over the fluid. However, In this case, if the fines as shown in FIGS. 12(A) to 12(F) are used, since the infrared rays are allowed to be incident upon only the fluid passing through the inside of the fins and not upon the fluid passing through the outside of the fins, the heating efficiency might be lowered.

Therefore, with the device using a working fluid having a relatively high light absorbability, it is preferable to adopt the fins of such types that the infrared rays of the lamp can be emitted to all over the fluid as that shown in FIGS. 8 and 9 or that shown in FIG. 12(G). On the other hand, with the device using only a fluid having an extremely low light absorbability, it is preferable to adopt the fins of any type including those as shown in FIGS. 8 and 9 and FIGS. 12(A) to 12(G).

With the corrugated fins as shown in FIGS. 12(A) to 12(F), there exists such an advantage that these fins can be manufactured and mounted on the inner vessel relatively easily.

Figure 1:
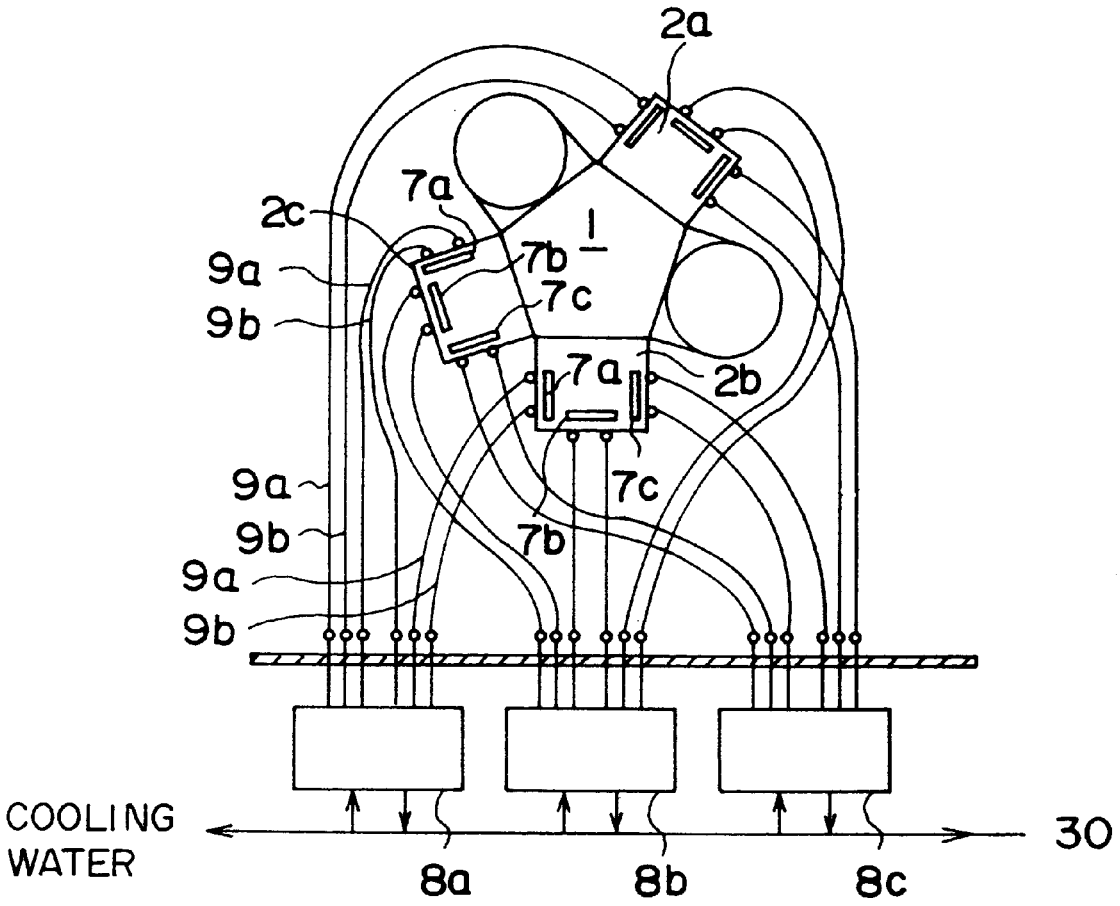
FIG. 1 is a plane view showing the semiconductor processing apparatus which uses the prior art temperature control system.

The above described fluid temperature control device according to the present invention can be applied not only to the distributed type multi-temperature control system as shown in FIG. 4, but also to various type temperature control apparatus such as the centralized type multi-temperature control system as shown in FIG. 1, the temperature control system for the constant temperature chamber and so on.

Figure 13:
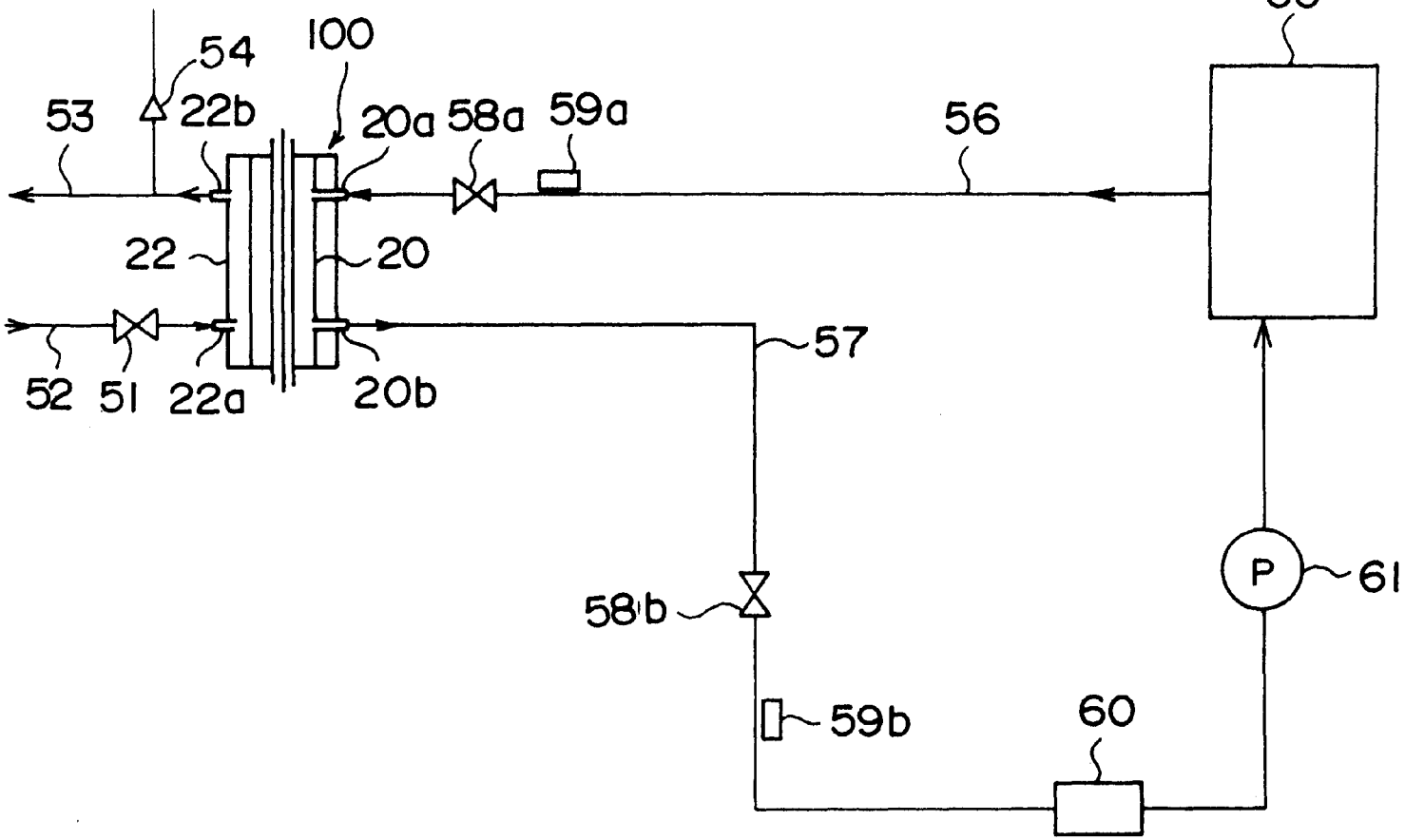
FIG. 13 is a circuit diagram showing the temperature control system using the fluid temperature control device according to the present invention.

FIG. 13 is a circuit diagram showing a temperature control system using the fluid temperature control device 100 according to the present invention.

In FIG. 13, a cooling liquid supply pipe 52 is connected to a cooling liquid inlet port 22*a* of the fluid temperature control device 100 via an open/close valve 51, and a cooling liquid outlet pipe 53 is connected to a cooling liquid outlet port 22*b* of the same device. A relief valve 54 is connected to the cooling liquid outlet pipe 13. Also, an additional relief valve may be connected on the upstream or downstream side of the open/close valve 51 of the cooling liquid supply pipe 52.

The fluid inlet port 20*a* of the fluid temperature control device 100 is connect to a fluid return pipe 16 for returning the working fluid from an object 55 of the temperature control, and the fluid outlet port 20*b* is connected to a fluid supply pipe 57 for supplying fluid to the object 55. The object 55 is an installation for which the temperature control is required such as a constant temperature chamber, plasma CVD apparatus chamber and the like. The temperature of the installation 55 is controlled by the working fluid supplied through the fluid supply pipe 57.

To the fluid return pipe 56 and the fluid supply pipe 57, open/close valves 58*a* and 58*b* and temperature sensors 59*a* and 59*b* for measuring the temperature of the working fluid flowing through the pipes 56 and 57 are connected, respectively. A deionization instrument 60 for removing ions from the fluid may be connected to the liquid supply pipe 57. Further, a pump 61 for circulating the working fluid is connected to either of the liquid supply pipe 57 or the liquid return pipe 56.

In the circuit as shown in FIG. 13, when the open/close valves 58*a* and 58*b* are opened and the pump 61 is actuated, the working fluid is circulated through the temperature control device 100 and the installation 55. Two temperatures of the working fluid are detected by the temperature sensors 59*a* and 59*b* at both the inlet port 20*a* and the outlet port 20*b*, respectively. The detected temperatures are transmitted to a controller (not shown). The controller controls the turn-on time or the electric power of the lamp and the flow rate of the cooling liquid so that the temperature of the fluid at the output port 1*b* matches the target temperature.

The above-mentioned embodiments have been explained for facilitating understanding of the gist of the present invention, so that the scope of the present invention is not limited only to the above-mentioned embodiments. That is, the above-mentioned embodiments can be changed, modified or improved into various modes, without departing from the spirit and scope thereof.

What is claimed is:

1. A multi-temperature control system for controlling temperature at a plurality of places using circulation of a working fluid, comprising:

a plurality of temperature control machines, each of said plurality of temperature control machines individually assigned to one of the plurality of places; and wherein each of the plurality of temperature control machines has a pair of fluid circulation pipes for circulating the working fluid for exclusive use in the assigned one of the plurality of places, and controls the temperature of the working fluid within the pair of the fluid circulation pipes individually.

2. The multi-temperature control system of claim 1, further comprising a cooling liquid source used in common for a plurality of the temperature control machines.

3. The multi-temperature control system of claim 1, wherein each of the temperature control machines comprises:

an inner vessel having an inner space for passing the working fluid;

a heater arranged in the inner space; and an outer vessel surrounding the inner vessel and having an outer space for passing a cooling liquid outside the inner vessel.

4. The multi-temperature control system of claim 3, wherein the heater includes a lamp for radiating infrared rays.

5. The multi-temperature control system of claim 1, wherein a plurality of the places are a plurality of process chambers provided for a reaction processing apparatus.

6. The multi-temperature control system of claim 1, wherein a plurality of the places are a plurality of portions of each of process chambers provided for a reaction processing apparatus.

7. The multi-temperature control system of either one of claims 5 and 6, wherein each of the temperature control machines is arranged in the vicinity of each process chamber.

8. A multi-temperature control system for controlling temperature of a plurality of places using circulation of a working fluid, comprising:

a plurality of temperature control machines each assigned to each of the places individually; and wherein:

each of the temperature control machines has a pair of fluid circulation pipes for circulating the working fluid for exclusive use of each of the places, and controls temperature of the working fluid within the pair of the fluid circulation pipes individually;

a plurality of the places or a plurality of portions of each of the process chambers provided for a reaction processing process; and each of the temperature control machines is arranged in the vicinity of each of the plurality of portions of each of the process chambers.

9. The multi-temperature control system of either one of claims 5 and 6, wherein each of the temperature control machines is arranged in the vicinity of the reaction processing apparatus.

10. A reaction processing apparatus provided with a plurality of process chambers each having at least one portion at which temperature is to be controlled, comprising:

a plurality of temperature control machines, each of said plurality of temperature control machines individually assigned to one of the plurality of process chambers; and wherein each of the plurality of temperature control machines is provided with a pair of fluid circulation pipes for circulating a working fluid for exclusive use in the assigned one of said plurality of process clambers, and controls temperature of the working fluid within the pair of fluid circulation pipes individually.

11. A reaction processing apparatus provided with at least one process chamber having a plurality of portions at each of which temperature is to be controlled, comprising:

a plurality of temperature control machines, each one of said plurality of temperature control machines being assigned to one of said plurality of portions of the process chambers;

wherein each of the plurality of temperature control machines is provided with a pair of fluid circulation pipes for circulating a working fluid for exclusive use in the assigned one of the plurality of portions of the process chamber, and controls temperature of the working fluid within the pair of the fluid circulation pipes individually.

12. A multi-temperature control system for controlling temperature at a plurality of places using circulation of a working fluid, comprising:

a plurality of fluid temperature control devices for controlling a temperature of the working fluid, each of said plurality of fluid temperature control devices being individually assigned to one of said plurality of places, each of said plurality of said fluid temperature control devices including:

a transparent cylinder;

a lamp arranged with said transparent cylinder, for radiating infrared rays;

a cylindrical vessel arranged so as to surround said transparent cylinder and having an inner space between said transparent cylinder and said cylindrical vessel;

a fluid inlet port for passing a fluid into the inner space;

a fluid outlet port for passing the fluid from the inner space; and inner fins arranged in the inner space in contact with an inner circumferential surface of said cylindrical vessel.

13. A multi-temperature control system for controlling temperature at a plurality of places using circulation of a working fluid, comprising:

at least one fluid temperature control device for controlling a temperature of the working fluid, said fluid temperature control device including:

a transparent cylinder;

a lamp arranged within said transparent cylinder, for radiating infrared rays;

a cylindrical vessel arranged so as to surround said transparent cylinder and having an inner space between said transparent cylinder and said cylindrical vessel;

a fluid inlet port for passing a fluid into the inner space;

a fluid outlet port for passing the fluid from the inner space; and inner fins arranged in the inner space in contact with an inner circumferential surface of said cylindrical vessel; and wherein said fluid temperature control device further including:

an outer cylinder arranged so as to surround said cylindrical vessel and having an outer space between said cylindrical vessel and said outer cylinder;

a cooling liquid inlet port for passing a cooling liquid into the outer space; and a cooling liquid outlet port for passing the cooling liquid from the outer space.

14. A reaction processing apparatus provided with a plurality of process chambers at which temperature is to be controlled using circulation of a working fluid, comprising:

a plurality of fluid temperature control devices for controlling a temperature of the working fluid, each of said plurality of fluid temperature control devices being individually assigned to one of said plurality of process chambers, each of said plurality of said fluid temperature control devices including:

a transparent cylinder;

a lamp arranged within said transparent cylinder, for radiating infrared rays;

a cylindrical vessel arranged so as to surround said transparent cylinder and having an inner space between said transparent cylinder and said cylindrical vessel;

a fluid inlet port for passing a fluid into the inner space;

a fluid outlet port for passing the fluid from the inner space; and inner fins arranged in the inner space in contact with an inner circumferential surface of said cylindrical vessel.

15. A reaction processing apparatus provided with process chambers at which temperature is to be controlled using circulation of a working fluid, comprising:

at least one fluid temperature control device for controlling a temperature of the working fluid, said fluid temperature control device including:

a transparent cylinder;

a lamp arranged within said transparent cylinder, for radiating infrared rays;

a cylindrical vessel arranged so as to surround said transparent cylinder and having an inner space between said transparent cylinder and said cylindrical vessel;

a fluid inlet port for passing a fluid into the inner space;

a fluid outlet port for passing the fluid from the inner space; and inner fins arranged in the inner space in contact with an inner circumferential surface of said cylindrical vessel; and wherein said fluid temperature control device further including:

an outer cylinder arranged so as to surround said cylindrical vessel and having an outer space between said cylindrical vessel and said outer cylinder;

a cooling liquid inlet port for passing a cooling liquid into the outer space; and a cooling liquid outlet port for passing the cooling liquid from the outer space.

* * * * *